US007505720B2

(12) United States Patent
Sugama et al.

(10) Patent No.: US 7,505,720 B2
(45) Date of Patent: Mar. 17, 2009

(54) DEVELOPING ROLLER AND DEVELOPING METHOD THEREOF

(75) Inventors: Kouichi Sugama, Hachioji (JP); Nobuaki Kobayashi, Hachioji (JP); Takeo Oshiba, Hachioji (JP); Okushi Okuyama, Hachioji (JP); Satoshi Uchino, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 11/585,399

(22) Filed: Oct. 24, 2006

(65) Prior Publication Data

US 2007/0147907 A1 Jun. 28, 2007

(30) Foreign Application Priority Data

Dec. 28, 2005 (JP) ..... 2005-377173

(51) Int. Cl.
*G03G 15/08* (2006.01)

(52) U.S. Cl. ..... 399/286; 399/279; 492/53

(58) Field of Classification Search ..... 399/279, 399/286; 430/120.1; 492/18, 49, 53, 56
See application file for complete search history.

(56) References Cited

U.S. PATENT DOCUMENTS

| | | | | |
|---|---|---|---|---|
| 6,087,434 | A * | 7/2000 | Hisashi et al. | 524/495 |
| 2002/0187413 | A1* | 12/2002 | Watanabe et al. | 430/108.8 |
| 2004/0190949 | A1* | 9/2004 | Yamaguchi et al. | 399/286 |
| 2006/0056881 | A1* | 3/2006 | Kim | 399/286 |
| 2007/0134150 | A1* | 6/2007 | Nagata | 423/445 B |

FOREIGN PATENT DOCUMENTS

| | | | |
|---|---|---|---|
| EP | 0 810 492 | A2 | 12/1997 |
| EP | 0 911 704 | A1 | 4/1999 |
| JP | 10-010800 | A * | 1/1988 |
| JP | 8-190263 | | 7/1996 |
| JP | 09-165512 | A * | 6/1997 |
| JP | 2001-356587 | | 12/2001 |
| JP | 2002-357949 | | 12/2002 |

OTHER PUBLICATIONS

European Search Report for Application No. 06122993.6-2209 mailed Apr. 23, 2007.

* cited by examiner

*Primary Examiner*—Sophia S Chen
(74) *Attorney, Agent, or Firm*—Cantor Colburn LLP

(57) ABSTRACT

Provided are a developing roller for non-magnetic single component development and a developing method employing the developing, by which toner can be stably conveyed in any external environment, and the stable toner conveyance and charging amount can also be acquired. Also disclosed is a developing roller possessing a spindle and provided around an outer circumference of the spindle, at least an elastic layer (innermost layer), a resistance adjusting layer (intermediate layer) formed on the elastic layer and a surface layer (outermost layer) formed on the resistance adjusting layer, wherein the intermediate layer possesses a layer containing carbon black in a resin, a content of a polycyclic aromatic hydrocarbon in the carbon black is at most 10 ppm, and a volume resistance (Rv) of all the layers provided around the outer circumference of the spindle is $1.0\times10^{7}$–$1.0\times10^{13}$ Ω·cm.

6 Claims, 3 Drawing Sheets

DEVELOPING ROLLER AND DEVELOPING METHOD THEREOF

This application claims priority from Japanese Patent Application No. 2005-377173 filed on Dec. 28, 2005, which is incorporated hereinto by reference.

TECHNICAL FIELD

The present invention relates to a developing roller and a non-magnetic single component development method employing the developing roller.

BACKGROUND

In the case of the non-magnetic single component development method, the structure of a developing device is simple, since the consumption volume of a developer is reduced because of using no carrier and the like, but toner only as a developer, and a mechanism of charging via friction between toner and a developing roller or a thin layer formation plate is employed. Accordingly, the non-magnetic single component development method is suitable for color image formation, since a compact size developing device is possible to be produced, and no magnetic material is further contained in toner in comparison to the case of a magnetic single component development method.

However, only a part has been turned into actual utilization in view of practical application of the electrographic image formation apparatus as a whole, despite the fact that many trials to put into practical application have been attempted so far.

This was attributed to the fact that a developing roller to play a major role for charge and development of toner was difficult to be produced, resulting in unstable performance of the developing roller.

One of the desired properties of the developing roller is to form a thin layer of toner and transport it in good condition, and needless to say, this is to be an important factor to obtain high image quality by charging the toner evenly.

Even though excellent results in toner conveyance performance of the developing roller are obtained at ambient temperature and normal humidity, however, the toner tends to be excessively conveyed at low-temperature and humidity since the amount of residual charge is increased, whereby the toner adhesion to the developing roller is also increased.

As to non-magnetic single component development, problems such as toner leakage, generation of fog on an image and toner fused onto a sleeve are produced both in contact development and in non-contact development, once the toner is excessively conveyed. In the case of the contact non-magnetic single component development, a problem such that the toner is fused onto a sleeve is particularly easy to be produced, and in the case of the non-contact non-magnetic single component development, a toner leakage problem tends to be produced.

(Patent Document 1) Japanese Patent O.P.I. Publication No. 2002-357949

(Patent Document 2) Japanese Patent O.P.I. Publication No. 2001-356587

(Patent Document 3) Japanese Patent O.P.I. Publication No. 8-190263

SUMMARY

The present invention was made on the basis of the above-described situation to solve the foregoing problems.

It is an object of the present invention to provide a developing roller for non-magnetic single component development and a developing method employing the developing roller, capable of acquiring stable images with neither leakage of toner nor image blur of fine lines and fog, in which toner can be stably conveyed in any external environment, and no toner is fused onto the developing roller.

After considerable effort during intensive studies, the inventors have found out that stable properties can be obtained even at low-temperature and humidity by having a content of PAH (polycyclic aromatic hydrocarbon) in the entire carbon black to be at most 10 ppm (by weight), after arranging volume resistance (Rv) of all the layers provided around an outer circumference of the spindle to $1.0\times10^{7}$–$1.0\times10^{13}$ Ω·cm, and by removing a slight amount of PAH in the carbon black contained in an intermediate layer of the developing roller as much as possible.

BRIEF DESCRIPTION OF THE DRAWINGS

Embodiments will now be described, by way of example only, with reference to the accompanying drawings which are meant to be exemplary, not limiting, and wherein like elements numbered alike in several figures, in which.

DESCRIPTION OF THE PREFERRED EMBODIMENTS

Figure 1:
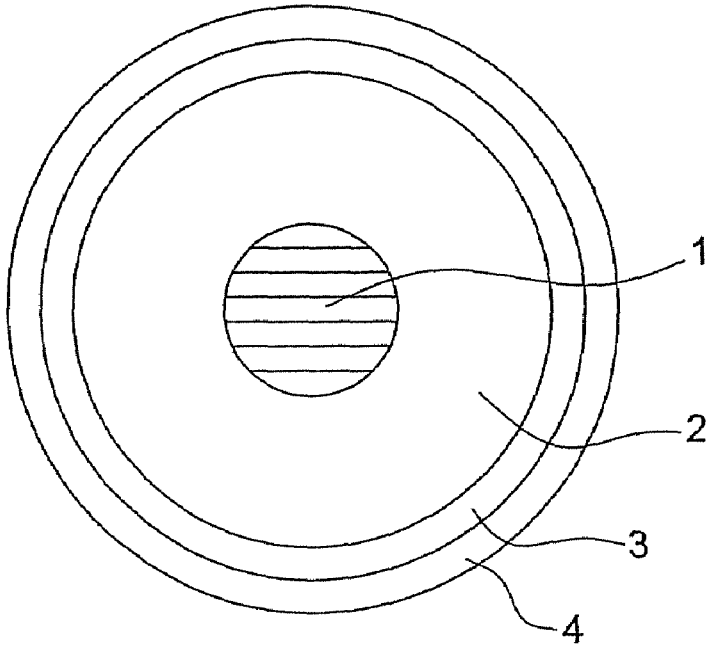
FIG. 1 is a schematic cross-sectional view showing a roller structure of the present invention.

The above object of the present invention is accomplished by the following structures.

(Structure 1) A developing roller comprising a spindle and provided around an outer circumference of the spindle, at least an elastic layer (innermost layer), a resistance adjusting layer (intermediate layer) formed on the elastic layer and a surface layer (outermost layer) formed on the resistance adjusting layer, wherein the intermediate layer comprises a layer containing carbon black in a resin, a content of a polycyclic aromatic hydrocarbon in the carbon black is at most 10 ppm, and a volume resistance (Rv) of all the layers provided around the outer circumference of the spindle is $1.0\times10^{7}$–$1.0\times10^{13}$ Ω·cm.

(Structure 2) The developing roller of Structure 1, wherein the surface layer further comprises a conductive agent.

(Structure 3) The developing roller of Structure 1 or 2, wherein the polycyclic aromatic hydrocarbon is formed from aromatic hydrocarbon compounds comprising naphthalene, fluorene, fluoranthene, chrysene, benzopyrene, anthracene, acenaphthylene and pyrene.

(Structure 4) A developing process comprising the step of conducting non-magnetic single component development employing the developing roller of any one of Structures 1-3.

The reason why the objective of the present invention is accomplished by the foregoing structures will be described below.

It is the basis of the present invention to produce a developing roller in which volume resistance (Rv) is set in the range exhibiting an appropriate developing property, and a volume resistance of $1.0\times10^{7}$–$1.0\times10^{13}$ Ω·cm is preferable for the foregoing basis.

The surface of a developing roller is usually covered by a surface layer made of silicone resin, or fluorinated resin such as teflon and the like in order to acquire surface strength to endure friction with toner or a thin layer formation plate serving also as a charging member to toner, together with appropriate charging and releasing performance to toner. A toner thin layer is evenly formed on the developing roller after passing through between a charging member and the developing roller, and a rubber elastic layer is also provided in such a way that force is applied to the toner as evenly as possible in order to obtain the toner evenly charged. An intermediate layer made of a silane coupling agent or such was provided in order to acquire adhesiveness in the case of a conventional technique, since adhesion between the surface-coated layer and the rubber elastic layer is not comparatively good. The coupling agent layer exhibits adhesion providing ability when it is used as a thin film, and since it also exhibits high resistivity, a thin film is desired to be prepared in order to set the developing roller to a predetermined value of resistance.

However, a thin and extremely even coupling agent layer is not easy to be prepared, and charge leakage is caused by unevenness of the intermediate layer thickness, whereby white spots are generated at solid black image portions, and black spots are also generated at solid white image portions (disclosed in back and while images).

The inventors tried to employ an intermediate layer having a thicker thickness at some level, and a conductive material such as carbon black is contained in the layer in order to obtain appropriate conductivity. However, this was still incomplete for obtaining stable properties in the diversified environment. Specifically at low-temperature and humidity, generated are deteriorated performance such as excessive toner conveyance, toner adhesion to the developing roller or degradation of developability caused by uneven charging.

The reason is that there exists a large amount of PAH in commonly known carbon black. It is considered that a barrier to prevent charge from moving at a carbon black particle-to-particle contact point is formed since this PAH is high-resistive, and tends to localize on the surface of carbon black particles.

Accordingly, in the case of a developing roller with commonly known carbon black having a large amount of PAH, localized charge accumulation is easy to be generated in a specific area, resulting in toner adhesion to the developing roller surface together with toner unevenly charged locally.

A carbon black function of avoiding appropriate charge leakage of a developing roller and excessive charge accumulation even at low-temperature and humidity, as well as of avoiding excessive toner conveyance, toner adhesion to the developing roller and degradation of developability is considered to be deteriorated by this.

Accordingly, the content of PAH contained in carbon black is controlled as low as possible, but it is almost impossible to zero the content as far as industrial manufacturing is concerned. The adverse effect of the above-described PAH content is possible to be removed by arranging the content to at most 10 ppm. Thus, the objective of the present invention is to be accomplished by the foregoing structures of the present invention.

In addition, a primary particle diameter of 20-40 nm is preferably usable as a carbon black particle diameter in the present invention, and the thickness of an intermediate layer having this diameter is 1-30 μm and preferably 5-20 μm.

While the preferred embodiments of the present invention have been described using specific terms, such description is for illustrative purposes only, and it is to be understood that changes and variations may be made without departing from the spirit or scope of the appended claims.

DETAILED DESCRIPTION OF THE INVENTION

Next, embodiments of the present invention will further be described.

[Preparation of Developing Roller]

The developing roller of the present invention, for example, can be produced as described below.

First, each component of a material to form base rubber layer 2 is kneaded with a kneader or such to prepare the material to form base rubber layer 2. After spindle 1 made of metal is set to a hollow portion of a cylindrical die, and the above material to form base rubber layer 2 is cast-molded into a spacing gap between the above cylindrical die and spindle 1, the die is covered and heated to crosslink the material to form base rubber layer 2. Formwork removal from the above cylindrical die is subsequently conducted to form base rubber layer 2 on the outer circumferential surface of spindle 1. The resulting in which the base rubber layer is formed on the outer circumferential surface of the spindle is designated as "base roller".

On the one hand, a material to form intermediate layer 3 is mixed with an organic solvent, and dissolved to prepare a solution. Subsequently, carbon black of the present invention is added into the resulting solution to prepare a solution to form intermediate layer 3. In this case, the carbon black is not dissolved in a solvent, but dispersed in the solvent.

A material to form surface layer 4 is mixed with an organic solvent to prepare a solution to form surface layer 4.

After this, a solution to form above intermediate layer 3 is coated on the outer circumferential surface of base rubber layer 2 of the above-described base roller. This coating method is not particularly limited, and a commonly known method such as a dipping method, a spray method or a roller coat method can be employed. A solvent in the solution to form intermediate layer 3 is subsequently removed to form intermediate layer 3 via drying and heat treatment after coating (vulcanizing treatment at 120-200° C. for 20-90 minutes). And then, a solution to form above surface layer 4 is coated on the outer circumferential surface of above intermediate layer 3. A commonly known method as the coating method can be employed similarly to the case of the solution to form above intermediate layer 3. A solvent in the solution to form above surface layer 4 is subsequently removed to form surface layer 4 via drying and heat treatment after coating (vulcanizing treatment at 120-200° C. for 20-90 minutes). In this way, a developing roller having a three-layer structure as shown in FIG. 1 can be prepared. As to this developing roller, base rubber layer 2 preferably has a thickness of 1-10 mm, and more preferably has a thickness of 2-6 mm. Intermediate layer 3 preferably has a thickness of 3-30 μm, and more preferably has a thickness of 5-20 μm. Surface layer 4 preferably has a thickness of 3-30 μm, and more preferably has a thickness of 5-20 μm. The thickness of each layer including above-described intermediate layer 3 can be measured via microscope observation after obtaining a cut plane sample including surface layer 4, intermediate layer 3 and base rubber layer 2 in the developing roller.

In addition, a developing roller having a three-layer structure was shown in FIG. 1 as an example of developing roller of the present invention, but the layer structure formed around the outer circumference of spindle 4 is not necessarily a three-layer structure, and a structure with more than three layers between base rubber layer 2 and intermediate layer 3 may be formed as roller usage.

The developing roller of the present invention includes an elastic layer, made of silicone rubber or such, on the right outer side of a conductive core metal material, and a surface layer, made of a fluorine based resin or such, on the outer side of the elastic layer, but at least one intermediate layer is formed between these layers to control a value of resistance as an adjusting function, since not only contact between the elastic layer made of silicone rubber or such and the surface layer made of a fluorine based resin or such is not always good, but also a developing roller is desired to be appropriately conductive.

[Carbon Black]

Carbon black of the present invention is one having a PAH content of at most 10 ppm.

PHA stands for polycyclic aromatic hydrocarbon, and PAH is used as generic entry of compounds having at least two benzene rings. Examples of main PAH compounds include naphthalene, fluorene, fluoranthene, chrysene, benzopyrene, anthracene, acenaphthylene, pyrene and so forth, and the total amount of these compounds is designated as the content of PAH.

Heat treatment of carbon black is conducted specifically as a PAH content controlling method to reduce a part of PAH via vaporization and degradation. Examples of the method include a method of heating to at least 200° C., and further a method of heating under inert atmosphere after reducing pressure to at most $1.33\times10^2$ Pa.

For example, air flow ($Nm^3/h$) at ambient temperature and fuel oil are introduced in a reactor to conduct spraying and form high temperature atmosphere after setting the ratio of air ($Nm^3/h$) to fuel oil (kg/h) to be air ($Nm^3/h$)/fuel oil (kg/h)=16-24, and preferably air ($Nm^3/h$)/fuel oil (kg/h)=18-20, and raw oil is introduced into the reactor at a spray pressure of at least 300 kPa. It is effective that the retention time until the reaction is terminated with reaction termination water at a reactor outlet is at least 2 seconds, and preferably at least 2.5 seconds. The resulting carbon black is also wet-granulated, and the total amount of naphthalene, fluorene, fluoranthene, chrysene, benzopyrene, anthracene, acenaphthylene and pyrene is possible to be reduced via a process of drying carbon black at 250-300° C. for 40-60 minutes, and vaporization and degradation of a part of PAH.

Concerning a method of producing carbon black, carbon black is manufactured employing a furnace type smelting furnace.

[Measuring Method of Polycyclic Aromatic Hydrocarbon (PAH)]

The content of polycyclic aromatic hydrocarbon was determined via liquid chromatography.

About 20 g of carbon black were weighed in advance, and it stood at 20° C. and 50% RH under atmospheric pressure (1013 hPa) for 24 hours. After this, about 5 g of carbon black were sampled and weighed to be recorded to 4 places of decimals.

Next, about 5 g of weighed carbon black is introduced into a cylindrical glass paper filter to conduct soxhlet extraction for 48 hours and subsequently concentrate this extracted liquid using 180 ml of toluene as a solvent. This extracted liquid after concentration was weighed to be recorded to 4 places of decimals.

From the extracted liquid after concentration, 20 μl of a sample liquid was introduced into a liquid chromatography analyzer. The content of each compound was determined from the resulting peak area and concentrated liquid weight corresponding to each of peak positions of a standard polycyclic aromatic hydrocarbon sample during preparation of the following calibration curve, and the sum was divided by the weight of carbon black used for extraction to obtain the content.

In addition, 20 μl of a sample liquid obtained by preparing four levels of concentration for each standard polycyclic aromatic hydrocarbon sample were introduced to determine quantity of each compound, and employed was the calibration curve prepared in advance via each concentration and the peak area.

The condition of liquid chromatography is indicated below.

Employing Liquid chromatography analyzer system (LC-10, manufactured by Shimadzu Corporation), 20 minutes at column: VYdac ODS, fluid phase: water/acetonitrile, concentration gradient of acetonitrile=$60+(t/5.85)^3$ where t=0-20, and then 2 minutes at 100% of acetonitrile concentration, liquid temperature: 35° C., and flow speed: 2 ml/min to make an analysis.

[Roller Structure]

The spindle is not particularly limited, and a cored metal bar having a diameter of about 5.0-30 mm, a metal rod or a hollow metal cylinder, for example, is employed. As the metal material, aluminum, stainless and iron are usable. The volume resistance of a spindle is preferably at most 10 Ω·cm.

Silicone rubber as a main component of elastic layer 2 formed on the outer circumferential surface of spindle 1 is not particularly limited, dimethyl silicone oil added into the resulting product in which a vinyl group is incorporated into a dimethyl silicone polymer as a crosslink site is preferably employed.

Incidentally, in the present invention, silicone rubber as a main component means that when base rubber layer 2 is made of silicone rubber only is also included.

The above-described silicone rubber incorporating a conductive agent such as carbon black (furnace black or acetylene black), metal oxide ($TiO_2$, ZnO, $SnO_2$ or iron oxide), graphite, potassium titanate, quaternary ammonium, borate or lithium salt is also possible to be used for base rubber layer 2.

The material to form intermideate layer 3, prepared on the outer circumferential surface of elastic layer 2 is not particularly limited, and any commonly known material is usable. Provided is, for example, a material in which a conductive agent such as carbon black (furnace black or acetylene black), metal oxide ($TiO_2$, ZnO, $SnO_2$ or iron oxide), graphite, potassium titanate, quaternary ammonium, borate or lithium salt is incorporated into hydrogen-adding acrylonitrile-butadiene copolymerization rubber (hydrogenated nitrile rubber: H-NBR), ethylene-propylenediene rubber (EPDM), styrene-butadiene rubber (SBR), nitrile rubber, polyurethane based elastomer, polyester or N-methoxymethylation nylon. Of these, the above H-NBR is preferable in view of good adhesion to a material to form surface layer 4.

A vulcanization accelerator or sulfur can also be incorporated appropriately into a material to form intermediate layer 3, other than the above-described material, if desired. Examples of the vulcanization accelerator include tetramethylthiuramdisulfide (TMTD), orth-tolyl-biguanidine, zinc dibutyldithiocarbamate and so forth. These are used singly or in combination with at least two kinds. Sulfur and such can be provide as the above-described vulcanization accelerator.

The material to form surface layer 4, prepared on the outer circumferential surface of intermideate layer 3 is not particularly limited, and any commonly known material is usable. Examples of the material include the admixture of urethane and acrylic urethane, acrylsilicone copolymer and so forth. In the case of using the admixture of urethane and acrylic urethane, it is preferable that the mixture ratio of urethane/acrylic urethane is set to be in the range of 10/90-90/10.

Further, a conductive agent may be appropriately added into a material to form surface layer 4. Examples of the conductive agent include carbon black (furnace black or acetylene black), metal oxide ($TiO_2$, ZnO, $SnO_2$ or iron oxide), graphite, potassium titanate, quaternary ammonium salt, borate and lithium salt. These are used singly or in combination with at least two kinds.

(Method of Measuring Volume Resistance)

The volume resistance can be measured by a commonly known method.

The conductivity of a developing roller is possible to be evaluated with volume resistance measured by the following method.

Figure 4:
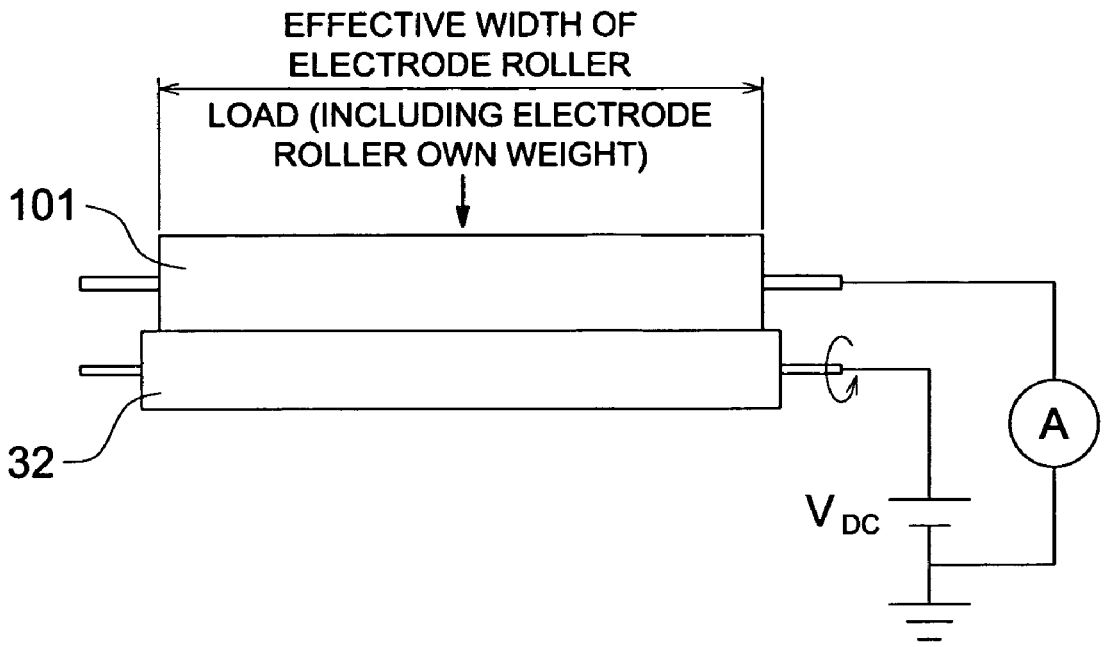
FIG. 4 is a schematic diagram showing an apparatus to measure volume resistance.

The volume resistance of the present invention is preferably $1\times10^{7}$–$1\times10^{13}$ Ω·cm. It is assumed that leakage current generated from the surface toward the spindle is controlled to some extent by having the volume resistance in the above-described range, whereby the objective of the present invention is to be easily achieved. When the volume resistance is in the above-described range, appropriate conductivity is exhibited. The volume resistance was measured by a metal roller electrode method employing an apparatus as shown in FIG. 4.

That is, stainless electrode roller 101 is brought into contact with developing roller 32, and pressed with a load of 9.8 N together with electrode roller 101 own weight. While rotating the roller in this situation, a voltage of +100 V is applied to an end of developing roller 32 to measure a current value. The developing roller resistance is determined by using following Formula (1). The calculated value obtained here becomes volume resistance (Rv) of all the layers provided around the outer circumference of a spindle, since the volume resistance of spindle 1 and developing roller 101 is low enough.

$$Rv=V_{DC}/I \qquad \text{Formula (1)}$$

(Measuring Conditions)

Measurement environment: 23° C. and 57 RH%

Applied voltage: +100 V

Roller rotation speed: 27 rpm

Electrode roller load: 9.8 N (including electrode roller own weight)

Effective width of electrode roller: 230 mm (30 mm in diameter)

Measured item: Current value (applied voltage: a mean value after 5 seconds)

[Developing Device, Image Forming Method and Image Forming apparatus]

(Developing Device)

An example of the non-magnetic single component developing method employing toner of the present invention is described, but embodiments in the present invention are not limited thereto.

Figure 2:
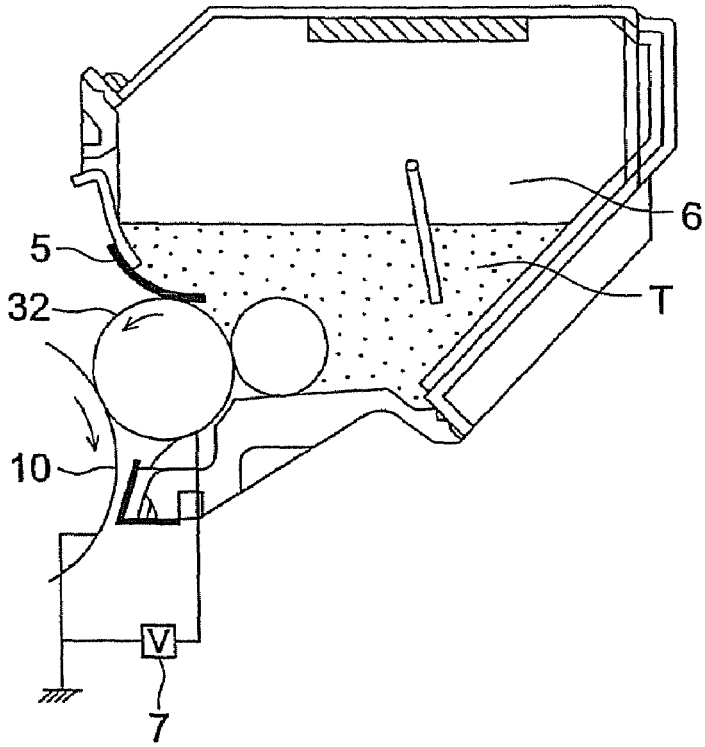
FIG. 2 is a schematic cross-sectional view showing a developing device used for non-magnetic single component toner development.

FIG. 2 is a schematic cross-sectional view showing a developing device for non-magnetic single component toner development.

Numeral 10 indicates a latent image carrier (photoreceptor drum), and the latent image is formed by a electrophotographic process means or a electrostatic recording means. Numeral 32 indicates a developing roller, in which an elastic layer is coated on a spindle made of aluminum, stainless or such.

Toner T is stored in hopper 6 and fed onto the surface of the developing roller by supplying roll. The supplying roll made of a foamed material such as polyurethane foam rotates forward or backward at a speed relative to the speed of developing roller 32 to supply the toner onto the surface of the developing roller and rub off the toner after development (undeveloped toner) from the surface of the developing roller. The toner supplied onto developing roller 32 is controlled by even thin toner layer formation and toner controlling blade 5 being a kind of charging members.

It is effective that a contact pressure between the toner controlling blade and the developing roller is 3-250 N/m as a linear pressure in the developing roller base line direction, and preferably 10-30 N/m. In the case of a contact pressure of less than 3 N/m, it is difficult to coat the toner evenly, and a problem caused by fog and scattered toner tends to be produced, since a charging amount distribution of toner becomes broader. In the case of a contact pressure exceeding 250 N/m, it is not preferable that toner coagulation is generated, since the toner is deteriorated by large pressure applied to the toner. It is not also preferable that a large torque is applied to operate the developing roller. That is, it becomes possible to effectively reduce the toner coagulation in the present invention, and also to raise the charging amount of toner instantaneously.

An elastic blade and an elastic roller are provided as a member to charge the toner and to make a thin toner layer formation, and are made of a material capable of charging toner with a desired polarity via frictional electrification.

A metal elastic material such as stainless, aluminum or phosphor bronze; and a rubber elastic material such as silicone rubber, urethane rubber or styrene-butadiene rubber are specifically usable. A complex layer, in which a polyamide resin, polyimide resin, a melamine resin, a phenol resin, a fluorine based resin, a silicone resin, a polyester resin, a urethane resin, a styrene resin or such is laminated, may also be formed on the foregoing material layer. Further, it is possible to improve a charge providing property by containing conductive rubber or conductive resin, or charge control agent or filler such as metal oxide, carbon black, inorganic whisker or inorganic fiber in the foregoing elastic material.

Preferable materials are silicone rubber, urethane rubber, styrene-butadiene rubber and so forth. Further, provided may be an organic resin layer made of polyamide, polyimide, nylon, melamine, melamine cross-linked nylon, a phenol resin, a fluorine based resin, a silicone resin, a polyester resin, an urethane resin or a styrene based resin. Further, a dielectric property or a charge providing property is given by dispersing electrically conductive resin, or filler or charge control agent such as metal oxide, carbon black, inorganic whisker or inorganic fiber into the blade rubber or blade resin, so that it is preferable that toner can be appropriately charged.

Incidentally, in the non-magnetic single component development to coat a thin layer of toner onto a developing sleeve with a blade, it is preferred that the toner layer thickness on the developing roller is arranged to be thinner than the facing gap length between the developing roller and the photoreceptor drum to realize a so-called non-contact development process, and an alternating electric field is applied to this gap to obtain sufficient image density. A gap of 50-500 μm is preferably provided between the developing roller surface and the photoreceptor surface, and a gap of 100-300 μm is more preferably provided. On the one hand, it is preferred that about 1-3 toner particle layer(s) is/are laminated for the toner layer provided on the developing roller, and the toner layer has a thickness of 5-30 μm. In addition, the thickness of the toner layer on the developing roller can be determined via microscope observation.

That is, a developing cartridge inserted in an actual image forming apparatus is exposed to parallel light from the cross-sectional direction of the developing process, and a photograph is taken employing a high-speed and high-resolution camera (FASTCAM MAX with a shooting speed of 100,000 (FPS), manufactured by Photoron Limited), whereby behavior of the developed portion which has been visualized can be measured.

Thickness of the toner layer on the developing roller is determined from the difference between (gap between the photoreceptor and the toner layer on the developing roller, which is a region close to the photoreceptor) and (gap at the center of developing nip between the developing roller and the photoreceptor).

The toner transfer from the developing roller surface onto the photoreceptor surface is facilitated, whereby a high quality image can also be obtained by applying an alternating electric field or a development bias in which a direct current electric field is superposed on an alternating electric field at the portion between developing roller 32 and photoreceptor drum 10 via bias source 7 as shown in FIG. 2.

(Image Forming Method and Image Forming Apparatus)

Figure 3:
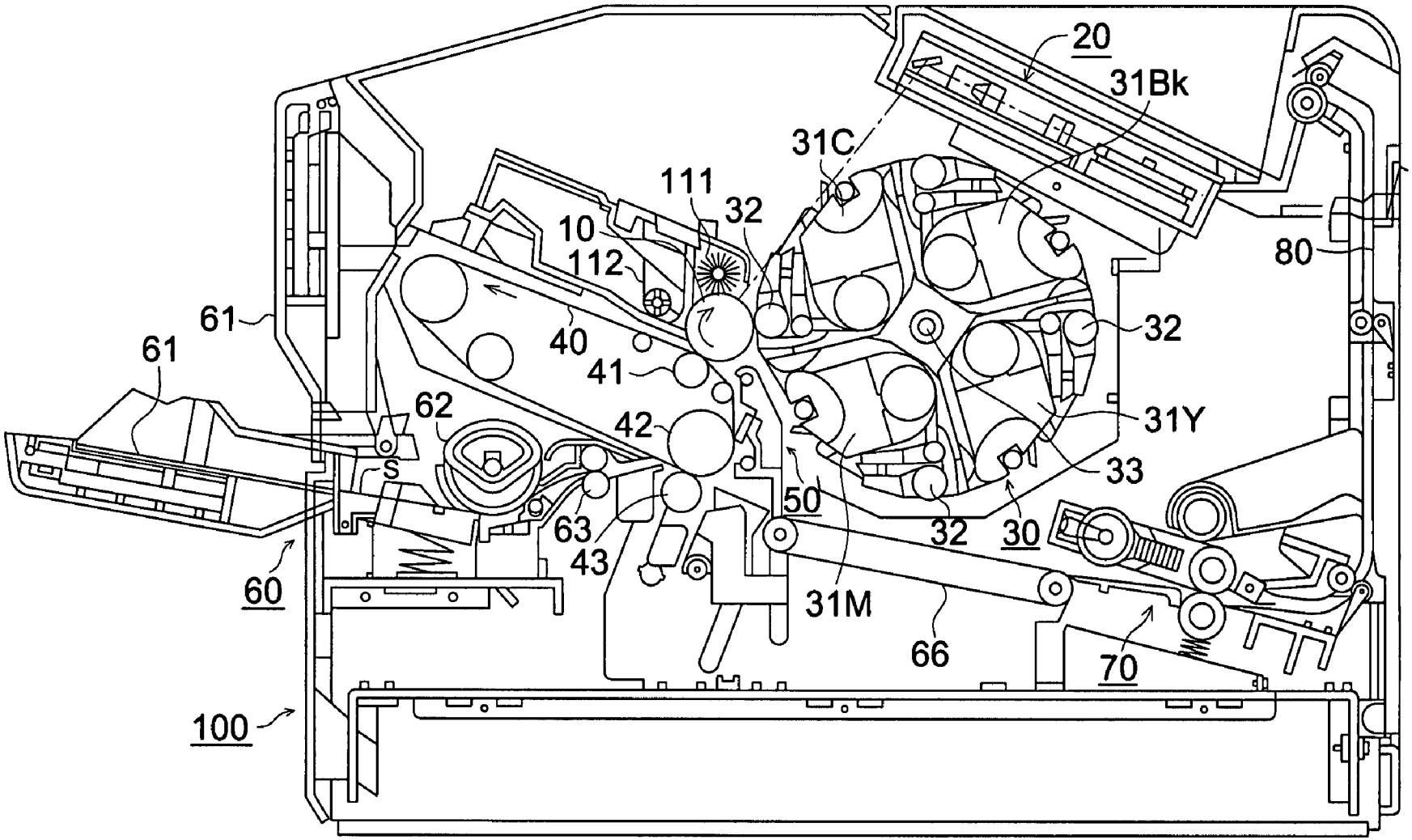
FIG. 3 is a schematic diagram showing an example of full color image forming apparatus.

An example of full color image forming apparatus for forming a full color image by using each of the above-described toners is described referring FIG. 3.

In the full color image forming apparatus shown in FIG. 3, charging brush 111 for uniformly charging the surface of photoreceptor drum 10 at a given potential, and cleaner 112 for scraping the toner remaining on photoreceptor drum 10 are arranged around photoreceptor 10.

Moreover, laser scanning optical system 20 for exposing photoreceptor 10 charged by charging brush 111 to a laser beam is provided. Laser scanning optical system 20 is known one including a laser diode, a polygon mirror and an fθ optical element, and cyan, magenta, yellow and black data to be printed are transferred from a host computer to the controlling means thereof. Laser scanning optical system 20 successively outputs laser beams according to the data of each of the above colors obtained via scanning exposure to photoreceptor drum 10 for successively forming electrostatic latent images on photoreceptor drum 10.

Developing apparatus 30 for supplying each of the color toners to photoreceptor drum 10 to perform full color development is constituted by four developing devices 31Y, 31M, 31C and 31Bk each containing a yellow, magenta, cyan and black non-magnetic single component toners, respectively, which are arranged around supporting axis 33. The developing devices can be rotated around supporting axis 33 so that each of developing devices 31Y, 31M, 31C and 31Bk is successively introduced at a position facing to photoreceptor drum 10.

In each of developing devices 31Y, 31M, 31C and 31Bk of full color developing apparatus 30, the toner regulation member is contacted by pressure to developer carrier 32 (developing roller) to convey toner by rotation, as shown in FIG. 4. The amount of toner conveyed by developing roller 32 is regulated by this toner regulation member and the conveyed toner is charged at the same time. In addition, in full color developing apparatus 30, two toner regulation members may be provided in order to suitably perform the regulation and charge the toner conveyed by the developing roller.

Full color developing apparatus 30 is rotated around supporting axis 33 every time the electrostatic latent image of each color is formed, so that developing devices 31Y, 31M, 31C and 31Bk each containing the corresponding color toner are successively introduced to the position where the developing device is faced to photoreceptor drum 10. And then each of the color toners is successively supplied onto the electrostatic latent image successively formed on the photoreceptor drum 10 by contacting developing roller 32 contained in each of developing devices 31Y, 31M, 31C and 31Bk to conduct the development.

Endless intermediate transfer belt 40 is provided at the lower course from full color developing apparatus 30 in the rotating direction of photoreceptor drum 10. Intermediate transfer belt 40 is driven to synchronously rotate with photoreceptor drum 10. Intermediate transfer belt 40 is contacted with photoreceptor drum 10 by pressing with rotatable primary transfer roller 41, and rotatable secondary transfer roller 43 is provided to face to support roller 42 supporting intermediate transfer belt 40. Recording material S such as recording paper is pressed to intermediate transfer roller 40 by secondary transfer roller 43.

Cleaner 50 for scraping off the toner remaining on intermediate belt 40 is provided in the space between full color developing apparatus 30 and intermediate transfer belt 40, so that cleaner 50 can be contacted to and released from intermediate transfer belt 40.

Paper supplying means 60 for introducing recording material S such as conventional recording paper into intermediate transfer belt 40 is composed of paper supplying tray 61 for storing recording material S, paper supplying roller 62 for supplying one by one recording material S stored in paper supplying tray 61 and timing roller 63 for sending recording material S between intermediate belt 40 and secondary transfer roller 43, supplied synchronously with the image formed on intermediate transfer belt 40. The recording material conveyed between intermediate transfer belt 40 and secondary transfer roller 43 is pressed against intermediate transfer belt 40 by secondary transfer roller 43, so that the toner image is transferred by press onto recording material S.

Recording material S on which the toner image is transferred by press is introduced into fixing device 70 with conveying means 66 composed of an air suction belt. The toner image transferred onto recording material S is fixed in fixing device 70, and then recording material S is take out onto the upper face of image forming apparatus 100 through vertical conveying pass 80.

Next, the procedure to form a full color image employing this full color image forming apparatus is described in detail.

Photoreceptor drum 10 and intermediate transfer belt 40 are rotated at the same circumferential speed in each of their directions and photoreceptor drum 10 is charged to a designated potential by charging brush 111.

An electrostatic latent image of a yellow image is formed via exposure of charged photoreceptor drum 10 according to the yellow image data by laser scanning optical system 20. And then a yellow image is developed by supplying a charged yellow toner onto photoreceptor drum 10 from developing device 31Y containing the yellow toner through the foregoing toner regulation members. The yellow toner image formed on photoreceptor drum 10 is primarily transferred onto intermediate transfer belt 40 by contacting intermediate transfer belt 40 by press to photoreceptor drum 10 with the primary transfer roller 41.

After the transfer of the yellow toner image onto intermediate transfer belt 40, full color developing apparatus 30 is rotated around supporting axis 33 for introducing developing device 31M containing magenta toner into the position facing to photoreceptor drum 10. And then the magenta image is exposed to laser scanning optical system 20 on charged photoreceptor drum 10 to form an electrostatic latent image in the same manner as in the yellow image formation. The electrostatic image is developed by the developing device 31M containing the magenta toner, and the developed magenta toner image is primarily transferred onto intermediate transfer belt 40 from the photoreceptor drum 10. Furthermore, exposure, development and primarily transfer of a cyan image and black image are successively performed, so that a full color toner image is formed by successively piling the yellow, magenta, cyan and black images on intermediate transfer belt 40.

After primarily transferring the last black image onto intermediate transfer belt 40, recording material S is conveyed with timing roller 63 between secondary transfer roller 43 and intermediate transfer belt 40, and the full color toner image formed on intermediate transfer belt 40 is secondarily transferred onto recording material S by pressing recording material S against intermediate transfer belt 40 with secondary transfer roller 43.

After secondarily transferring the full color toner image onto recording material S, recording material S is introduced into fixing device 70 by conveying means 66. The toner image transferred onto recording material S is fixed by fixing device 70, and then recording material S is taken out onto the upper surface of image forming apparatus 100 through vertical conveying pass 80.

[Non-Magnetic Single Component Developer (Toner)]

The manufacturing method and the composition of toner in the present invention are not particularly limited, and an example is provided as a typical example here.

A non-magnetic single component developer is preferably employed as a developer usable in the present invention. Preferably employed as a toner constituting the non-magnetic single component developer is a chemical toner such as a polymerization toner prepared via a process of forming resin particles by polymerizing a polymirizable monomer in an aqueous medium.

It is preferable that a particle diameter of a developer (toner) used in the present invention is 3-9 μm in volume-based median diameter (volume $D_{50}$% diameter). The ratio of the developer (toner) having a volume-based median diameter of at most 4 μm is preferably at most 25%, and it is preferable that the ratio of the developer having a volume-based median diameter of at least 12 μm is also at most 1%.

The above-described volume-based median particle diameter and the ratio of the developer (toner) having a volume-based median diameter of at most 4 μm or at least 12 μm can be measured and calculated by using Coulter Multisizer II (produced by Beckman Coulter Inc.), connected to a computer system (produced by Beckman Coulter Inc.) for data processing.

After 20 ml of the surfactant solution (surfactant solution in which a neutral detergent containing a surfactant is diluted with pure water by 10 times) is mixed with 0.02 g of toner for the measurement, the mixture was subjected to an ultrasonic dispersion for one minute to obtain a toner dispersion. This toner dispersion is then poured, using a pipette, in a beaker containing ISOTON II (produced by Beckman Coulter Inc.) placed in a sample stand, until the measured content reaches 5-10% by weight, and a counter is set to 30000 counts to be measured. In addition, an aperture diameter of 100 μm is used.

A developer (toner) having a particle diameter and a particle diameter distribution in the foregoing range is filled in a developing device and a process cartridge by a commonly known filling method, whereby an excellent toner image with no image unevenness is stably obtained by forming an image employing this unit. The developer quality is maintained by adjusting the particle diameter of the developer (toner) in a specific range in this manner, since fluidity at the same level is given to each developer (toner particle) when fluidizing the developer during filling the developer to charge the toner into the unit constantly under the same conditions.

[Preparation Method of Developer (Toner)]

Next, a preparation method of a developer (toner) usable for the present invention will be described.

An example of polymerization toner formed via a process of coagulating resin particles in an aqueous medium is provided as the toner preferably usable in the present invention.

The resin particle having a weight average particle diameter of 20-500 nm is usable, and resin particles having such the particle size are possible to be prepared via emulsion polymerization.

The process of coagulating resin particles in an aqueous medium is a process in which a salting-out agent having at least critical coagulation concentration, and containing an alkaline metal salt, an alkaline earth metal salt or such is added into water dispersing at least resin particles, colorant particles and wax particles, and coagulation is subsequently conducted by heating to at least glass transition temperature of the resin particles (hereinafter, referred to also as salting-out) to fuse at the same time. After this, this coagulation process is designated as a salting-out/fusing process.

The toner of the present invention is different from toner prepared by a fusing method after forming primary coagulated particles which are resin particles, colorant particles and wax particles, and presumably, evenly charged toner is possible to be stably obtained with no damage of evenness of toner particles, since salting-out and fusing of the particles proceed at the same time to prepare toner particles.

Alkali metal atoms of alkali metal salts and alkali earth metal salts, employed as salting-out agents, are lithium, potassium, sodium and the like, and alkali earth metal atoms are magnesium, calcium, strontium, barium and the like. Of these, potassium, sodium, magnesium, calcium and barium are preferable.

Examples of those forming alkali metal salts and alkali earth metal salts include chlorides, bromides, iodides, carbonates, sulfates, and the like.

Further, listed as organic solvents infinitely soluble in water are alcohols such as methanol, ethanol, 1-propanol, 2-propanol, ethylene glycol, glycerin, acetone, and the like, but methanol, ethanol, 1-propanol, and 2-propanol which are alcohols having at most 3 carbon atoms are preferable. Of these, 2-propanol is more preferable.

In the salting-out/fusion process, it is preferable that hold-over time after the addition of salting-out agents is as short as possible. The reason for this is not clearly understood. However, problems are produced such that the coagulation state of particles varies depending on the hold-over time after salting out so that the particle diameter distribution becomes unstable and surface properties of fused toner particles fluctuate.

It is preferred that the temperature, at which a salting-out agent is added, is not more than the glass transition temperature of resin particles. When the temperature, at which a salting-out agent is added, is not less than the glass transition temperature of resin particles, a problem such that particles having a large particle diameter are formed is produced, since it becomes difficult to control the particle diameter though salting-out/fusion of resin particles proceeds quickly. This addition temperature is preferably at most the glass transition temperature of resin particles, and generally 5-55° C. and preferably 10-45° C.

It is also possible that a salting-out agent is added at not more than the glass transition temperature of resin particles, and subsequently the temperature is quickly increased to not less than the glass transition temperature of resin particles by heating.

It is preferable that time required up to the increased temperature is less than one hour. It is further preferred that the temperature is quickly increased by heating, and the rate of temperature increase is 0.25-5° C./minute. The maximum rate of temperature increase is not particularly limited, but the salting-out and the control of a particle diameter can be appropriately performed by arranging the rate of temperature increase in the above-described range.

(Polymerizable Monomer)

As resin particles, resin particles prepared via emulsion polymerization are usable. As a polymerizable monomer to prepare the resin particles, radically polymerizable monomer (1) is employed as a component, and crosslinking agent (2) can be used, if desired. It is also desired to contain at least one kind of radically polymerizable monomers having the following acidic group (3). A radically polymerizable monomer having a basic group (4) may further be contained.

(1) Radically Polymerizable Monomer

The radically polymerizable monomer component are not particularly limited, and a commonly known polymerizable monomer component is usable.

For example, usable are aromatic vinyl monomer, (meta) acrylate based monomer, vinylester based monomer, vinyl ether based monomer, monoolefin based monomer, diolefin based monomer and so forth.

Examples of the aromatic vinyl monomer include styrene based monomers such as styrene, o-methylstyrene, m-methylstyrene, p-methylstyrene, p-methoxystyrene, p-phenylstyrene, p-chlorostyrene, p-ethyl styrene, p-n-butylstyrene, p-tert-butylstyrene, p-n-hexyl styrene, p-n-octyl styrene, p-n-nonyl styrene, p-n-decyl styrene, p-n-dodecyl styrene, 2,4-dimethyl styrene, 3,4-dichloro styrene, and derivatives thereof.

Examples of the (meta)acrylate based monomer include methyl acrylate, ethyl acrylate, butyl acrylate, 2-ethylhexyl acrylate, cyclohexyl acrylate, phenylacrylate, methyl methacrylate, ethyl methacrylate, butyl methacrylate, hexyl methacrylate, methacrylic acid-2-ethylhexyl, β-hydroxy ethyl acrylate, γ-amino propyl acrylate, methacrylic acid stearyl, dimethylaminoethyl methacrylate, methacrylic acid diethylaminoethyl and so forth.

Listed as vinyl ester based monomers are vinyl acetate, vinyl propionate, vinyl benzoate and the like.

Listed as vinyl ether based monomers are vinyl methyl ether, vinyl ethyl ether, vinyl isobutyl ether, vinyl phenyl ether and the like.

Listed as monoolefin based monomers are ethylene, propylene, isobutylene, 1-butene, 1-pentene, 4-methyl-1-pentene and the like.

Listed as diolefin based monomers are butadiene, isoprene, chloroprene and the like.

(2) Crosslinking Agent

A crosslinking agent such as radically polymerizable crosslinking agent may be added in order to improve characteristics of toner.

As the radically polymerizable crosslinking agent, those having at least two unsaturated bonds such as divinylbenzene, divinyl naphthalene, divinyl ether, diethyleneglycol methacrylate, ethylenglycol dimethacrylate, polyethyleneglycol dimethacrylate and diallyl phthalate are exemplified.

Though the amount of radically polymerizable crosslinking agent depends on the properties, 0.1-10 parts by weight of radically polymerizable crosslinking agent are preferably used with respect to 100 parts by weight of total radically polymerizable monomer.

(3) Radically Polymerizable Monomer Having Acidic Group

Examples of the radically polymerizable monomer having acidic group include a monomer containing a carboxyl group and a monomer containing a sulfonic acid group.

Examples of the carboxylic acid group-containing monomer include acrylic acid, methacrylic acid, fumaric acid, maleic acid, itaconic acid, cinnamic acid, maleic acid monobutyl ester and maleic acid monooctyl ester.

Examples of the sulfonic acid group-containing monomer include styrenesulfonic acid, allylsulfo succinic acid, allyl sulfo succinic acid octyl.

These may have a structure of alkali metal salt of sodium or potassium, or alkaline earth metal salt of calcium.

(4) Radically Polymerizable Monomer Having Basic Group

An amine based compound such as primary amine, secondary amine, tertiary amine or a quaternary ammonium salt is usable as a radically polymerizable monomer having a basic group.

As amine based compounds, for example, dimethylaminoethyl acrylate, dimethylaminoethyl methacrylate, diethylaminoethyl acrylate, diethylaminoethyl methacrylate and quaternary ammonium salt of the 4 compounds mentioned above, 3-dimethylaminophenyl acrylate, 2-hydroxy-3-methacryloxy propyl trimethylammonium salt, acrylamide, N-butylacrylamide, N,N-dibutyl acrylamide, piperidyl acrylamide, methacryl amide, N-butyl methacryl amide, N-octadecyl acrylamide; vinylpyridine, vinylpyrrolidone; and vinyl N-methylpyridinium chloride, vinyl N-ethyl pyridinium chloride, N,N-diallyl methylammonium chloride, and N,N-diallyl ethylammonium chloride.

<Radical Polymerization Initiator>

A radical polymerization initiator used for emulsion polymerization can be appropriately employed if the radical polymerization initiator is water-soluble. Examples of the initiator include persulfate such as potassium persulfate and ammonium persulfate; azo based compounds such as 4,4'-azobis-4-cyano valeric acid and the salt thereof, 2,2'-azobis(2-amidino propane) salt; and peroxide compounds.

The above radical polymerization initiator can be employed as redox initiator compounds in combination with reducing agent if desired. It is expected that polymerization is activated by using the redox initiator compounds, polymerization temperature can be lowered, and polymerization time can further be shortened.

Polymerization temperature may be optionally selected if it is at least the minimum radical generation temperature of polymerization initiator, but a temperature range of 50-90° C. is preferable. Polymerization is also possible to be done at room temperature or more by employing a polymerization initiator working at normal temperature such as combination of hydrogen peroxide-reducing agent (ascorbic acid and so forth).

<Surfactant>

It is preferred to use a surfactant to conduct emulsion polymerization for the foregoing radically polymerizable monomer. Surfactants usable in this case are not particularly limited, but anionic and nonionic surfactants listed below are usable.

Examples of the anionic surfactant include sulfonate such as dodecyl benzene sulfonic acid sodium, arylalkyl polyethersulfone acid sodium, 3,3-disulphone diphenylurea-4,4-diazo-bis-amino-8-naphthol-6-sodium sulphonate, ortho-carboxy benzene-azo-dimethylaniline) or 2,2,5,5-tetramethyl-triphenyl methane-4,4-diazo-bis-β-naphthol-6-sodium sulphonate; sulfuric ester salt such as sodium dodecyl sulfate, sodium tetradecyl sulfate, pentadecyl sodium sulfate or sodium octylsulphate; and fatty acid salt such as sodium oleate, lauric acid sodium, capric acid sodium, caprylic acid sodium, caproic acid sodium, stearic acid potassium or oleic acid calcium.

Examples of the nonionic surfactant include polyethylene oxide, polypropylene oxide, combination of polypropylene oxide and polyethylene oxide, ester of polyethyleneglycol and higher fatty acid, alkylphenol polyethylene oxide, ester of higher fatty acid and a polyethyleneglycol, ester of higher fatty acid and polypropylene oxide, and sorbitan ester.

These are mainly employed for emulsifying agent in emulsion polymerization. They may be used in other process or other purpose of use.

<Colorant>

Inorganic pigment and organic pigment are usable as a colorant.

Commonly known black pigment and magnetic pigment can be provided as the inorganic pigment.

Carbon black such as furnace black, channel black, acetylene black, thermal black or lamp black is exemplified as black pigment.

The inorganic pigment can be used singly, or plural kinds can be employed in combination, if desired. The addition amount of inorganic pigment is preferably 2-20 parts by weight with respect to 100 parts of toner, and preferably 3-15 parts by weight. (hereinafter, "Parts" represents "parts by weight", unless otherwise mentioned)

Commonly known organic pigment is usable as the organic pigment. The following examples are specifically listed, though any organic pigment is usable.

Examples of the pigment for magenta or red include C.I. pigment red 2, C.I. pigment red 3, C.I. pigment red 5, C.I. pigment red 6, C.I. pigment red 7, C.I. pigment red 15, C.I. pigment red 16, C.I. pigment red 48; 1, C.I. pigment red 53; 1, C.I. pigment red 57; 1, C.I. pigment red 122, C.I. pigment red 123, C.I. pigment red 139, C.I. pigment red 144, C.I. pigment red 149, C.I. pigment red 166. C.I. pigment red 177, C.I. pigment red 178, and C.I. pigment red 222.

Examples of the pigment for orange or yellow include C.I. pigment orange 31, C.I. pigment orange 43, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, and C.I. pigment yellow 138.

Examples of the pigment for cyan or green include C.I. pigment blue 15, C.I. pigment blue 15:2, C.I. pigment blue 15:3, C.I. pigment blue 16, C.I. pigment blue 60, and C.I. pigment green 7.

These organic pigments can be used singly or two kinds or more can be selected in combination if desired. The addition amount of the pigment is preferably 2-20 parts with respect to 100 parts of toner, and is more preferably 3-15 parts.

Commonly known wax usable for toner is exemplified. Examples thereof include polyolefin wax such as polyethylene wax and polypropylene wax; long chain hydrocarbon wax such as paraffin wax and sasol wax; dialkylketone type wax such as distearylketone; ester type wax such as carnauba wax, montan wax, trimethylolpropane tribehenate, pentaerythritol tetramyristate, pentaerythritol tetrabehenate, pentaerythritol diacetate dibehenate, glycerin tribehenate, 1,18-octadecanediol distearate, trimellitic acid tristarate, and distearyl meleate; and amide type wax such as ethylenediamine dibehenylamide and trimellitic acid tristearylamide.

<Additives>

A commonly known charge control agent other than wax and a colorant can be added into toner usable in the present invention to give various functions.

<Filtrating/Washing Process>

Toner particles formed by coagulating resin particles in the salting-our/washing process are filtrated from an aqueous medium, and washed with water to remove impurities of a surfactant and a salting-out agent adhering to the toner particles. The filter and washer employed in this process are not particularly limited, but a centrifuge separator, a Buchner funnel, a filter press and so forth, for example, are employed.

<Drying Process>

Toner particles are dried after filtrating and washing. Dryers employed in this process are not particularly limited, but usable are a spray dryer, a vacuum-freeze dryer, a vacuum dryer, a stationary shelf dryer, a mobile shelf dryer, a fluidized-bed dryer, a tumble-drier, and a stirring type dryer. The water content in toner after drying is preferably at most 5% by weight, and more preferably at most 2% by weight.

<Pulverizing Process>

This process may not be employed, but weak coagulation situation might occur after drying toner particles. In this case, the coagulated toner base material may be pulverized by using pulverizing treatment apparatus such as a jet mill, a Henschel mixer or a coffee mill.

<Toner-Forming Process>

The resulting toner particles as-is may be used in the toner-forming process, but external additives described later are preferably added to improve fluidity or an electrostatic property and to enhance cleaning capability, for example.

Devices of adding external additives are not particularly limited, but usable are commonly known mixers such as a turbulent mixer, Henschel mixer, a Nauta mixer and a V-type mixer.

Further, toner of the present invention may be employed as a non-magnetic single component developer, but it may be used as a magnetic single component developer in some cases.

<External Additives>

External additives are not particularly limited, various inorganic particles, organic particles and lubricants are usable as external additives.

Commonly known inorganic particles are usable. Particles of silica, titanium and alumina are preferable, and hydrophobic inorganic particles are further preferable.

Examples of silica particles include R-805, R-809, R-812, R-972, R-974 and R-976 produced by Nihon Aerosil Co., Ltd.; HVK-2150 and H-200 produced by Hoechst company; and TS-530, TS-610, TS-720, H-5 and MS-5 produced by Cabot company.

Examples of titanium particles include T-604 and T-805 produced by Nihon Aerosil Co., Ltd.; MT-100B, MT-10S, MT-500BS, MT-600, MT-600SS and JA-1 produced by TAYCA Corp.; TA-300SI, TA-500, TAF-130, TAF-510 and TAF-510T produced by Fuji titanium company; and IT-S, IT-OA, IT-OB and IT-OC produced by Idemitsu Kosan company.

As alumina particles, RFY-C and C-604 produced by Nihon Aerosil Co., Ltd., TTO-55 of produced by ISHIHARA SANGYO KAISHA, LTD. are given for example.

Spherical organic particles having a number average primary particle diameter of approximately 10-2000 nm are preferably usable as organic particles. Homopolymer such as styrene or methyl methacrylate and copolymer of these are specifically usable.

Metal salts of higher fatty acid are preferably usable as lubricant. Specific examples thereof include stearic acid salt of zinc, aluminum, copper, magnesium or calcium; oleic acid salt of zinc, manganese, iron, copper or magnesium; palmitic acid salt of zinc, copper, magnesium or calcium; and linoleic acid salt of zinc or calcium.

The addition amount of these external additives are preferably 0.1-5 parts with respect to 100 parts of toner.

EXAMPLE

Next, the embodiments referring to examples inside the present invention and comparative examples outside the present invention will be described in detail, but the present invention is not limited thereto.

Incidentally, in the description, "Parts" represents "parts by weight", unless otherwise mentioned.

[Preparation of Carbon Black]

Carbon Black a

Employing a furnace type smelting furnace, 4200 $Nm^3/h$ of air at ambient temperature and 210 kg/h of fuel oil are introduced and burned. In this case, a ratio of air ($Nm^3/h$) to fuel oil (kg/h) is 20.

Next, 950 (kg/h) of raw oil (creosote oil: C/H=14.7 and BHCI=158) containing 140 ppm of potassium carbonate was sprayed at a spray pressure of at least 0.35 Mpa from a center portion of the hearth, and pyrolytically decomposed at a high temperature of 1500° C. to prepare carbon black in a retention time of 2.9 sec. The resulting was further wet-granulated, and dried in a hot-air drying process at 280° C. for 60 minutes to obtain a product. The final form is granular.

The content of polycyclic aromatic hydrocarbon was determined via liquid chromatography.

About 20 g of carbon black were weighed in advance, and it stood at 20° C. and 50% RH under atmospheric pressure (1013 hPa) for 24 hours. After this, about 5 g of carbon black were sampled and weighed to be recorded to 4 places of decimals.

Next, about 5 g of weighed carbon black is introduced into a cylindrical glass paper filter to conduct soxhlet extraction for 48 hours and subsequently concentrate this extracted liquid using 180 ml of toluene as a solvent. This extracted liquid after concentration was weighed to be recorded to 4 places of decimals.

From the extracted liquid after concentration, 20 μl of a sample liquid was introduced into a liquid chromatography analyzer. The content of each compound was determined from the resulting peak area and concentrated liquid weight corresponding to each of peak positions of a standard polycyclic aromatic hydrocarbon sample during preparation of the following calibration curve, and the sum was divided by the weight of carbon black used for extraction to obtain the content.

In addition, 20 μl of a sample liquid obtained by preparing four levels of concentration for each standard polycyclic aromatic hydrocarbon sample were introduced to determine quantity of each compound, and employed was the calibration curve prepared in advance via each concentration and the peak area.

The condition of liquid chromatography is indicated below.

Employing Liquid chromatography analyzer system (LC-10, manufactured by Shimadzu Corporation), 20 minutes at column: VYdac ODS, fluid phase: water/acetonitrile, concentration gradient of acetonitrile=$60+(t/5.85)^3$ where t=0–20, and then 2 minutes at 100% of acetonitrile concentration, liquid temperature: 35° C., and flow speed: 2 ml/min to make an analysis.

The PAH content of the resulting carbon black is shown in Table 1.

TABLE 1

| Kinds of compounds | PAH content in carbon black (ppm) | | | | |
|---|---|---|---|---|---|
| for PAH | a | b | c | d | e |
| Pyrene | 0.2 | 0.6 | 0.5 | 0.9 | 116.4 |
| naphthalene | 0.0 | 0.0 | 0.0 | 0.0 | 12.7 |
| anthracene | 0.0 | 4.7 | 3.1 | 5.2 | 0.0 |
| fluorene | 0.0 | 1.2 | 0.9 | 2.5 | 0.2 |
| acenaphthylene | 0.0 | 0.0 | 3.5 | 1.6 | 0.0 |
| Fluoranthene | 0.0 | 1.1 | 1.5 | 1.3 | 16.0 |
| chrysene | 0.0 | 0.1 | 0.1 | 0.2 | 0.7 |
| benzopyrene | 0.0 | 0.0 | 0.1 | 0.2 | 0.8 |
| Total content | 0.2 | 7.7 | 9.7 | 11.9 | 146.8 |

Carbon Black b

Carbon black b was prepared similarly to preparation of carbon black a, except that the wet granulation was not conducted in preparation of carbon black a. The PAH content in the resulting carbon black was measured by the above-described method, and shown in Table 1.

Carbon Black c

After combustion of 240 kg/h of fuel oil with 4300 $Nm^3/h$ of air, carbon black was prepared with 850 kg/h of raw oil containing 160 ppm of potassium carbonate. The resulting was further wet-granulated, and dried in a hot-air drying process at 250° C. for 40 minutes to obtain a product. Carbon black c was prepared similarly to preparation of carbon black a, except that the above-described items were conducted in preparation of carbon black a. The granular carbon black was obtained as the final form. The PAH content in the resulting carbon black is shown in Table 1.

Carbon Black d

Carbon black d was prepared similarly to preparation of carbon black a, except that 1400 kg/h of raw oil containing 100 ppm of potassium carbonate was employed after combustion of 250 kg/h of fuel oil with 4500 $Nm^3/h$ of air in preparation of carbon black a. The PAH content in the resulting carbon black is shown in Table 1.

Carbon Black e

Carbon black e at the level of the same surface area as that of carbon black d was prepared similarly to preparation of carbon black d, except that a furnace type smelting furnace was replaced by a horizontal type furnace. The PAH content in the resulting carbon black is shown in Table 1.

Example 1

Preparation of Base Roller

The core metal made of aluminum was prepared as a core metal to coat an adhesive on the outer circumferential surface of the core metal. Next, after the above core metal was set to the hollow portion of a cylindrical die, and a silicone rubber compound adding carbon black c was injected into a gap portion between the cylindrical die and the core portion by molding, the die was covered by a lid, and heated at 180° C. for 5 minutes to vulcanize the silicone rubber compound. Subsequently, formwork removal was conducted to produce a base rubber layer-coated core metal (base roller).

[Preparation of Intermediate Layer Forming Solution]

Next, 20 parts of particles having an average particle diameter of 20 μm, made of a urethane resin (BURNOCK CFB100, produced by Dainippon Ink and Chemicals, Inc.) were dispersed and mixed into a polymer solution obtained by mixing 100 parts of polyurethane based elastomer (UN278, produced by Sakai Kagaku Kogyo Co., Ltd.), 20 parts of carbon black a, 10 parts of a crosslinking agent and 400 parts of MEK (methylethylketone), while stirring to prepare an intermediate layer forming solution.

[Preparation of Surface Layer Forming Solution]

The surface layer forming solution was prepared by mixing 100 parts of an urethane resin (Nipporan 5199, produced by Nippon Polyurethane Industry Co., Ltd.), 20 parts of carbon black c and 400 parts of MEK.

The drying and heat treatment were conducted after coating the above-described intermediate layer forming solution onto the circumferential surface of the foregoing base roller by a roller coat method. The drying and heat treatment were further conducted after coating the above-described surface layer forming solution onto the circumferential surface of the above-described intermediate layer by a roller coat method to form a surface layer on the circumferential surface of the intermediate layer. In this way, a developing roller having a three layer structure was produced. Thicknesses of a base rubber layer, an intermediate layer and a surface layer of this roller are 5 mm, 10 μm and 15 μm, respectively.

Example 2

Developing roller of Example 2 was prepared similarly to Example 1, except that particles dispersed in an intermediate layer forming solution were replaced by carbon black b.

Example 3

Developing roller of Example 3 was prepared similarly to Example 1, except that particles dispersed in an intermediate layer forming solution were replaced by carbon black c.

Example 4

Developing roller of Example 4 was prepared similarly to Example 3, except that particles dispersed in a surface layer forming solution were replaced by carbon black e.

Example 5

Developing roller of Example 5 was prepared similarly to Example 3, except that particles dispersed in an elastic layer forming solution were replaced by carbon black d.

Comparative Example 1

Developing roller of Comparative Example 1 was prepared similarly to Example 1, except that particles dispersed in an intermediate layer forming solution were replaced by carbon black d.

Comparative Example 2

Developing roller of Comparative Example 2 was prepared similarly to Example 1, except that particles dispersed in an intermediate layer forming solution were replaced by carbon black e.

Comparative Example 3

Developing roller of Comparative Example 3 was prepared similarly to Example 1, except that 10% by weight of carbon black c was added into silicone rubber compound of Example 1.

Comparative Example 4

Developing roller of Comparative Example 4 was prepared similarly to Example 1, except that 30% by weight of carbon black c was added into silicone rubber compound of Example 1.

Comparative Example 5

Developing roller of Comparative Example 5 was prepared similarly to Example 1, except that 30% by weight of carbon black c was added into silicone rubber compound of Example 1, and particles dispersed in an intermediate layer forming solution were replaced by carbon black e.

[Preparation of Non-Magnetic Single Component Developer (Single Component Toner)]

(1) Preparation of colorant particle dispersion

In a resin container having an inner volume of 20 L, 0.90 kg of Sodium n-dodecylsulfonic acid (ADEKAHOPE LS −90, produced by Asahi Denka Co., Ltd.) and 10.0 L of pure water were charged, and dissolved while stirring. While stirring, 1.20 kg of carbon black (REGAL 330R, produced by Cabot Co., Ltd) is gradually added into this solution, and subsequently stirred for one hour. After this, the resulting solution is continuously dispersed for 18 hours employing a sand grinder (medium type homogenizer).

The particle diameter of the above-described dispersion, which was measured employing an electrophoresis light scattering photometer (ELS-800, produced by Ohtsuka Denshi Co.) after homogenizing, was 118 nm in weight average particle diameter. The solid content of the above-described dispersion, measured by a weight method via ventilation drying was 16.5% by weight. This dispersion was designated as "colorant dispersion Bk".

"Colorant dispersion C" was prepared similarly to the above procedures, except that REGAL 330R was replaced by C.I. Pigment Blue 15:3 in the manufacturing process of the above-described colorant particle dispersion. "Colorant dispersion M" was also prepared similarly to the above procedures, except that REGAL 330R was replaced by C.I. Pigment Red 122 in the manufacturing process of the above-described colorant particle dispersion. "Colorant dispersion Y" was further prepared similarly to the above procedures, except that REGAL 330R was replaced by C.I. Pigment Yellow 74 in the manufacturing process of the above-described colorant particle dispersion.

(2) Preparation of Wax Particle Dispersion

Into 2.45 kg of an aqueous surfactant (nonylphenoxyethanol) solution, 1.05 kg of acidic modification low molecular weight polypropylene (number average molecular weight=3000) is added to adjust pH to 9 with potassium hydroxide.

Temperature of this system is increased under pressure to at least the softening temperature of the foregoing acidic modification low molecular weight polypropylene, and emulsion-dispersing treatment of the acidic modification low molecular weight polypropylene is conducted to prepare a releasing agent particle dispersion having a solid content of 30% by weight. This dispersion was designated as "releasing agent particle dispersion 1".

The average particle diameter of releasing agent particles in the resulting "releasing agent particle dispersion 1", which was measured employing an electrophoresis light scattering photometer (ELS-800, produced by Ohtsuka Denshi Co.), was 122 nm in number average primary particle diameter.

(3) Preparation of Resin Particle Dispersion 1

In a 10 L stainless pot, 4.0 L of ion-exchange water is added into 56 g of sodium dodecylbenzenesulfonate (produced by Kanto Chemical Co., Inc.), and dissolved at room temperature while stirring. This was designated as "anionic surfactant solution A".

In a 10 L stainless pot, 4.0 L of ion-exchange water is added into 15 g of Newcall 565C (produced by Nippon Nyukazai Co., Ltd.), and dissolved at room temperature while stirring. This was designated as "nonionic surfactant solution B".

In a 20 L enamel pot, 12.0 L of ion-exchange water is added into 226.5 g of potassium peroxide (produced by Kanto Chemical Co., Inc.), and dissolved at room temperature while stirring. This was designated as "initiator solution C".

In a 100 L glass-lining vessel fitted with a temperature sensor, a condenser and a nitrogen gas-introducing device, "anionic surfactant solution A" and "nonionic surfactant solution B" are charged and stirred, and 44.0 L of ion-exchange water is subsequently added into the resulting.

Next, the temperature is increased, and "initiator solution C" is added at a liquid temperature of 75° C. While controlling a temperature to 75° C.±1° C., charged are 12.70 kg of styrene, 3.20 kg of n-butyl acrylate, 96 g of methacrylic acid and 554.1 g of t-dodecylmercaptan.

The liquid temperature is further raised to 78° C.±1° C., and heating is conducted while stirring for 7 hours.

The liquid temperature is subsequently cooled down to at most 40° C. to terminate stirring. This liquid was filtrated by a Pall filter to prepare "resin particle dispersion 1".

A part of "resin particle dispersion 1" was sampled, and an acid value of resin particles in a dispersion, a peak in a molecular weight distribution via GPC and a weight average particle diameter were measured to be an acid value of 3.9, a GPC peak position of 12,800 and a weight average particle diameter of 119 nm, respectively.

(4) Preparation of Resin Particle Dispersion 2

In another 10 L stainless pot, 4.0 L of ion-exchange water is added into 56 g of sodium dodecylbenzenesulfonate (produced by Kanto Chemical Co., Inc.), and dissolved at room temperature. This was designated as "anionic surfactant solution D".

In a 10 L stainless pot, 4.0 L of ion-exchange water is added into 15 g of Newcall 565C (produced by Nippon Nyukazai Co., Ltd.), and dissolved at room temperature. This was designated as "nonionic surfactant solution E". In a 20 L enamel pot, 12.0 L of ion-exchange water is added into 207.0 g of potassium peroxide (produced by Kanto Chemical Co., Inc.), and dissolved at room temperature. This was designated as "initiator solution F".

In a 100 L glass-lining vessel (with a Pfaudler impeller) fitted with a temperature sensor, a condenser, a nitrogen gas-introducing device and a comb baffle, "anionic surfactant solution D" and "nonionic surfactant solution E" are charged and stirred, and 44.0 L of ion-exchange water is subsequently added into the resulting.

Next, the temperature of the solution is increased, and "initiator solution F" is added at a liquid temperature of 70° C. After this, charged is a solution in which 13.50 kg of styrene, 2.40 kg of n-butyl acrylate, 100 g of methacrylic acid and 9.26 g of t-dodecylmercaptan are mixed in advance.

The liquid temperature is subsequently controlled to 72° C.±2° C., and heating is conducted for 6 hours. The liquid temperature is further raised to 78° C.±2° C., and heating is conducted for 13 hours.

Then, after cooling down to a liquid temperature of at most 40° C., this liquid is filtrated by a Pall filter to prepare "resin particle dispersion 2".

A part of "resin particle dispersion 2" was sampled, and an acid value of resin particles in a dispersion, a peak in a molecular weight distribution via GPC and a weight average particle diameter were measured to be an acid value of 4.1, a GPC peak position of 239,700 and a weight average particle diameter of 115 nm, respectively.

(5) Association Process

In a 35 L stainless pot, 5.36 kg of sodium chloride (produced by Wako Pure Chemical Industries, Ltd.) and 20.0 L of ion-exchange water are charged and dissolved. This was designated as "sodium chloride solution G".

Next, in a 100 L stainless vessel fitted with a temperature sensor, a condenser, a nitrogen gas-introducing device and a comb baffle (with an anchor impeller), 20.0 kg of "resin particle dispersion 1", 5.0 kg of "resin particle dispersion 2", 0.4 kg of "colorant dispersion Bk", 6.50 kg of "releasing agent particle dispersion 1" and 20.0 L of ion-exchange water, which are prepared above, are charged, and stirred. Then, the temperature is raised to 40° C., 25 g of "sodium chloride solution G" 6.00 kg of isopropanol (produced by Kanto Chemical Co., Inc.) are added in this order. Next, after standing for 10 minutes, the temperature is raised to a liquid temperature of 85° C., spending 60 minutes. The temperature was controlled to 85° C.±2° C., and coagulating/fusing treatment was conducted by heating for 6 hours to prepare "colored particle 1Bk".

Then, after cooling down to a liquid temperature of at most 40° C., stirring is terminated. Filtration was conducted employing a sieve of 45 μm mesh to obtain "associated solution" containing colored particles.

(6) Washing and Drying of Colored Particles

Next, "wet cake colored particle 1 Bk" is extracted from an associated employing a Buchner funnel, and washed with ion-exchange water.

The resulting "Wet cake colored particle 1 Bk" after washing was dried employing a flash dryer. A drying temperature of the flash dryer was set to 35° C., and drying treatment was conducted for 100 minutes to obtain colored particle 1 Bk.

(7) Preparation of Toner 1 (Bk)

Into 100 parts of the resulting colored particle 1 Bk, 0.8 parts of hydrophobic silica having a number average primary particle diameter of 12 nm was added to prepare toner 1 (Bk) having a volume-based median particle diameter of 5.0 μm.

(8) Preparation of Toner 1 (Y), Toner 1 (M) and Toner 1(C)

Colored particle 1 Y, colored particle 1 M and colored particle 1 C each were prepared similarly to the procedures in the association process of colored particle 1 Bk, except that "colorant dispersion Bk" was replaced by "colorant dispersion Y", "colorant dispersion M" and "colorant dispersion C", respectively. Into the resulting colored particle 1 Y, colored particle 1 M and colored particle 1 C each, 0.8 parts of hydrophobic silica having a number average primary particle diameter of 12 nm was added to prepare toner 1 (Y), toner 1 (M) and toner 1 (C), respectively, which have a volume-based median particle diameter of 5.0 μm.

[Image Evaluation]

A developing roller was installed in a non-contact non-magnetic single component development type electrophotographic printer having the same structure as shown in FIG. 2 to print practically at low-temperature and humidity (10° C. and 20% RH) or at room-temperature and humidity (25° C. and 55% RH). Two thousand A4 size practical prints were taken in a pixel ratio of 20% (5% of each color of yellow, magenta, cyan and black in full color mode). An original image having a pixel ratio of 10% (an A4 size original image document allocating four equal quarters for each of a fine line image, a color portrait, a solid white image, and a solid black image) was printed out after printing 2000 prints to make evaluation visually.

That is, "A" indicates that fine lines are clearly printed with no problems with respect to a portrait, a solid white image and a solid black image after printing 2000 prints. "NG (no good)" indicates that image blur and fog are generated. In addition, image blur means that fine lines are broken, and fog means that toner is scattered at the portion where no image is present.

[Leakage of Scattered Toner/Toner Fusion]

Observed were the leakage of scattered toner and toner fused on a developing roller in the printer after printing 2000 prints in the above-described image evaluation.

A: Neither leakage of scattered toner nor toner fused on a developing roller is observed.

B: Either leakage of scattered toner or toner fused on a developing roller is slightly observed (but practically with no problem).

C: Both leakage of scattered toner and toner fused on a developing roller are a little observed (practically unfavorable).

D: Both leakage of scattered toner and toner fused on a developing roller are observed (practically with a problem).

Volume resistance (Rv) of all the layers provided around the outer circumference of a spindle of each developing roller and performance evaluation results at low-temperature and humidity measured by the foregoing measuring method (refer to FIG. 4) are shown in following Table 2.

TABLE 2

| Example/ Comparative example | Volume resistance (Ω · cm) | Performance evaluation: Image evaluation | Performance evaluation: Leakage of scattered toner/toner fusion |
|---|---|---|---|
| Example 1 | $1.1 \times 10^{8}$ | A | A |
| Example 2 | $1.2 \times 10^{11}$ | A | A |
| Example 3 | $1.6 \times 10^{12}$ | A | B |
| Example 4 | $8.1 \times 10^{12}$ | A | B |
| Example 5 | $6.3 \times 10^{12}$ | A | B |
| Comparative Example 1 | $1.5 \times 10^{13}$ | NG | D |
| Comparative Example 2 | $1.1 \times 10^{15}$ | NG | D |
| Comparative Example 3 | $1.2 \times 10^{14}$ | NG | C |
| Comparative Example 4 | $1.5 \times 10^{6}$ | NG | C |
| Comparative Example 5 | $1.2 \times 10^{6}$ | NG | C |

As is clear from above Table 2, it is to be understood that Examples 1-5 of the present invention exhibit excellent properties, but Comparative examples 1-5 outside the present invention exhibit properties inferior to those of the present invention.

As is also clear from Examples 5-6, good properties of the developing roller can be obtained without using carbon black of the present invention, in which the PAH content is suppressed to low levels, for an elastic layer or a surface layer, when volume resistance (Rv) of all the layers provided around the outer circumference of the spindle is arranged to be set in the range of the present invention, employing the carbon black satisfying conditions of the present invention for an intermediate layer.

In addition, regarding performance evaluation results at room-temperature and humidity, there is not much difference between Examples 1-5 and Comparative examples 1-5, resulting in no problem.

EFFECT OF THE INVENTION

In the present invention, provided can be a developing roller for non-magnetic single component development and a developing method employing the developing roller, capable of acquiring stable images with neither leakage of toner nor image blur of fine lines and fog, in which toner can be stably conveyed in any external environment, and no toner is fused onto the developing roller.

What is claimed is:

1. A developing roller comprising a spindle and provided around an outer circumference of the spindle, at least an elastic layer (innermost layer), a resistance adjusting layer (intermediate layer) formed on the elastic layer and a surface layer (outermost layer) formed on the resistance adjusting layer, wherein the intermediate layer comprises a layer containing carbon black in a resin, a content of a polycyclic aromatic hydrocarbon in the carbon black is at most 10 ppm, and a volume resistance (Rv) of all the layers provided around the outer circumference of the spindle is $1.0\times10^{7}$–$1.0\times10^{13}$Ω·cm.

2. The developing roller of claim 1, wherein the surface layer further comprises a conductive agent.

3. A developing process comprising the step of conducting non-magnetic single component development employing the developing roller of claim 2.

4. The developing roller of claim 1, wherein the polycyclic aromatic hydrocarbon is formed from aromatic hydrocarbon compounds comprising naphthalene, fluorene, fluoranthene, chrysene, benzopyrene, anthracene, acenaphthylene and pyrene.

5. A developing process comprising the step of conducting non-magnetic single component development employing the developing roller of claim 3.

6. A developing process comprising the step of conducting non-magnetic single component development employing the developing roller of claim 1.

* * * * *